United States Patent [19]

Walters

[11] 4,280,466

[45] Jul. 28, 1981

[54] EVAPORATIVE EMISSION CONTROL DEVICE

[75] Inventor: Leslie K. Walters, Rochester, Mich.

[73] Assignee: General Motors Corporation, Detroit, Mich.

[21] Appl. No.: 23,597

[22] Filed: Mar. 26, 1979

[51] Int. Cl.[3] ..... F02M 25/08; F02M 33/02

[52] U.S. Cl. ..... 123/520

[58] Field of Search ..... 123/136, 518–521

[56] References Cited

U.S. PATENT DOCUMENTS

| | | | |
|---|---|---|---|
| 3,093,124 | 6/1963 | Wentworth | 123/136 |
| 3,352,294 | 11/1967 | Biller et al. | 123/136 |
| 3,393,669 | 7/1968 | Vardi et al. | 123/136 |
| 3,515,107 | 6/1970 | Joyce | 123/136 |
| 3,575,152 | 4/1971 | Wentworth | 123/136 |
| 3,683,597 | 8/1972 | Beveridge et al. | 123/136 X |
| 3,884,204 | 5/1975 | Krautwurst et al. | 123/136 |
| 4,203,401 | 5/1980 | Kingsley et al. | 123/136 |

OTHER PUBLICATIONS

1977 G. M. Annual Report on Advanced Emission Control System Development Progress, vol. 1, Jan. 16, 1978, p. IV E 5–8.

*Primary Examiner*—Stuart S. Levy
*Attorney, Agent, or Firm*—Arthur N. Krein

[57] ABSTRACT

In an engine with an evaporative emission control system, a main fuel vapor storage canister is vented to a secondary fuel vapor storage canister disposed so as to capture fuel vapor discharged from the main canister and to receive air heated by a heat stove on the engine whereby fuel vapor within the secondary canister can be completely and rapidly purged during engine operation.

2 Claims, 3 Drawing Figures

EVAPORATIVE EMISSION CONTROL DEVICE

FIELD OF THE INVENTION

This invention relates to evaporative emission control systems for internal combustion engines and, in particular, to an evaporative emission control device and its use in such a system whereby to capture the fuel vapors displaced from the engine fuel system.

DESCRIPTION OF THE PRIOR ART

In recent years, most automotive vehicles have been equipped with an evaporative emission control or fuel vapor recovery system of the type shown, for example, in U.S. Pat. No. 3,683,597 entitled "Evaporation Loss Control" issued Aug. 15, 1972 to Thomas R. Beveridge and Ernst L. Ranft. In such a system a vapor storage canister is used to receive and store vapors emitted from the engine fuel system. These fuel vapors are received from the fuel tank of the engine and from the fuel bowl of the carburetor, if the latter is used on the engine. Such canisters contain a vapor adsorbent material, such as activated charcoal. By means of suitable conduits and appropriate flow control valves, the canister is adapted to receive fuel vapors emitted from the fuel tank and from the float bowl and to store these vapors so that during engine operation, the stored fuel vapors can be purged from the canister into the engine induction system for consumption within the engine.

In the cycle between engine operations, the greatest quantity of fuel vapors is emitted from the fuel bowl during the so-called hot soak cycle, the condition that occurs immediately after engine shut down. Of course, fuel vapors are emitted from the fuel tank to the canister as a result of diurnal losses.

If the canister in such a system should become saturated with fuel vapor, any additional vapor displaced from the fuel tank or carburetor fuel bowl will travel through the canister and out its vent to the atmosphere. Moreover, even when the canister is not saturated, the flow of air and fuel vapor through the canister causes some of the fuel vapor previously stored in the canister to be purged out the canister vent to the atmosphere.

This latter condition can occur because the fuel vapor from the fuel bowl is the first to be discharged into the adsorbent material of the canister due to the hot-soak condition immediately after engine shut down. Then at a later period and time additional fuel vapor will flow to the canister from the fuel tank. This later flow of fuel vapor from the fuel tank can cause this, so-called, back purge of vapor from the canister. That is, in effect, vapor will be caused to overflow from the canister into the atmosphere through the vent passage or passages of the canister that are provided thereon for the normal entry of atmospheric air into the canister to effect purging of fuel vapors therefrom during engine operation, in a manner known in the art.

Earlier proposals to prevent this loss of fuel vapor through the canister involved either increasing the size of the canister or venting the canister through a supplementary canister.

SUMMARY OF THE INVENTION

The present invention relates to an evaporative emission control system having incorporated therein a secondary canister providing a flow path therethrough with an inlet at one end connected to receive heated air from a heat stove on an engine and an outlet at the other end connected in flow communication with the induction system of the engine. A bed of vapor adsorbent material is disposed in the flow path through the secondary canister and this bed of material is operatively connected to the vent passage of a primary canister whereby to receive any fuel vapor purged therefrom.

Accordingly, it is a primary object to this invention to provide an improved evaporative emission control system utilizing a secondary canister arranged to be purged by heated air during engine operation whereby the secondary canister is operative to substantially, if not completely, prevent the back purge of fuel vapors to the atmosphere.

Another object of this invention is to provide an improved evaporative emission control system by having incorporated therein a secondary canister with a bed of adsorbent material positioned in the flow path therethrough, the secondary canister being adapted to be supplied with heated air during engine operation whereby purging of fuel vapors from the secondary canister and from a primary canister operatively connected thereto can be rapidly effected.

For a further understanding of the invention, as well as other objects and further feature thereof, reference is had to the following detailed description to be read with the accompanying drawings.

Figure 1:
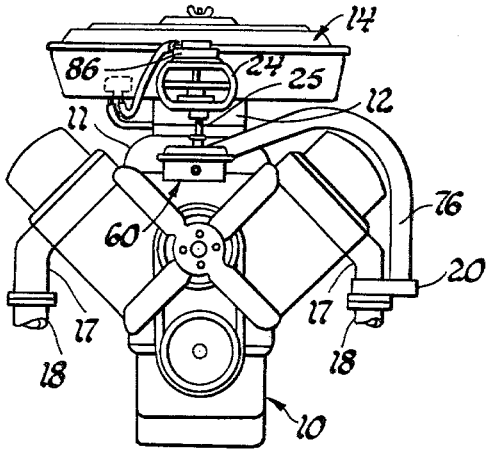
FIG. 1 is a front elevational view of an internal combustion engine having an air cleaner assembly operatively associated with an engine heat stove for controlling the temperature of induction air flow, and showing the location of the secondary canister of an evaporative emission control system in accordance with the invention associated with the engine.
Figure 2:
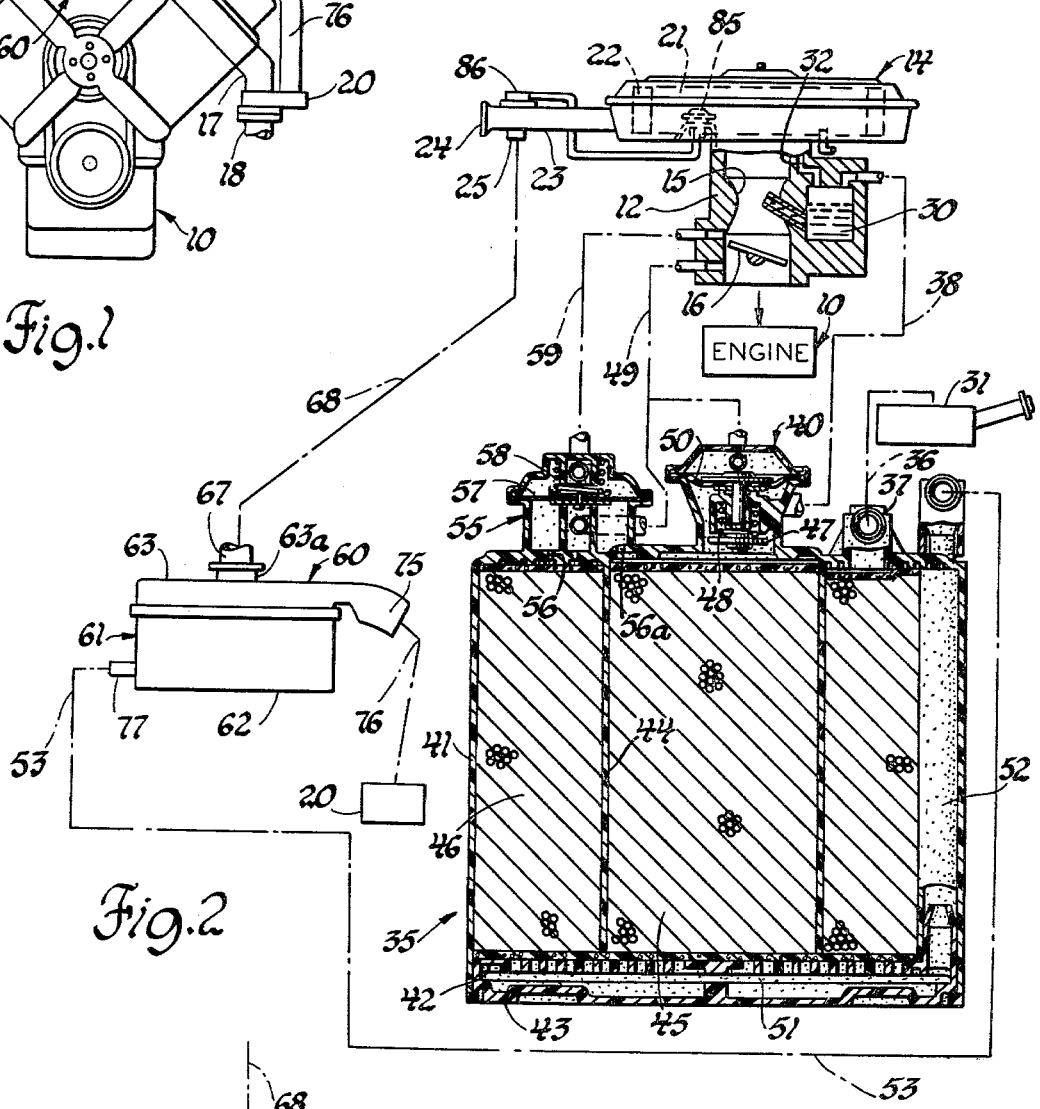
FIG. 2 is a side elevational view of a portion of the engine of FIG. 1 with an evaporative emission control system in accordance with the invention shown schematically associated therewith; and, FIG. 3 is a cross-sectional view in elevation of the secondary canister, per se, of the evaporative emission control system shown in FIGS. 1 and 2.

Referring first to FIGS. 1 and 2, an internal combustion engine 10 includes an intake manifold 11 and a carburetor 12 on which an air cleaner assembly 14 is mounted. Intake manifold 11 and carburetor 12 form an induction passage 15 (FIG. 2) in which a throttle 16 is pivotably movable to control the flow of induction fluid to the engine 10. Engine 10 also includes, in the construction shown, an exhaust manifold 17 for each bank of cylinders, not shown. Each exhaust manifold discharges exhaust gases out through an exhaust pipe 18 associated therewith. A conventional heat stove 20 is disposed in heat exchange relationship with an exhaust manifold 12, in the construction shown, whereby to provide a source of heated air.

As best seen in FIG. 2, the air cleaner assembly 14 defines a chamber 21 therein in which an air filter 22 is disposed. A tuned conduit in the form of a snorkel 23 has a flared end 24, open to air at ambient or underhood temperatures, for the delivery of air to the chamber 21. Snorkel 23 also has a lateral opening 25 adapted to receive air heated by the heat stove 20 whereby warm air can be delivered, in a manner to be described, into the air stream flowing via the snorkel 23 to chamber 21.

Carburetor 12 has a fuel bowl 30 which receives liquid fuel from a fuel tank 31 through a fuel line, not shown, in a conventional manner. Fuel bowl 30 delivers fuel to the induction passage 15 in a conventional manner and has an internal vent 32 to maintain the fuel bowl pressure equal to that in the inlet portion of induction passage 15, that is, in the portion of the induction passage 15 upstream of the throttle 16.

Fuel emitted from both the fuel tank 31 and from the fuel bowl 30 is stored in a canister generally designated 35 which contains a bed of vapor storage material, such as activated charcoal. Canister 35 may be of any suitable type such as that disclosed, for example, in the above-identified U.S. Pat. No. 3,683,597 or, as illustrated, it may be of the type disclosed in copending application Ser. No. 7,490 entitled "Evaporative Emission Canister" filed Jan. 29, 1979 in the names of Charles Allen Kingsley, James Richard Spaulding and William Elihu Gifford, now U.S. Pat No. 4,203,401, and assigned to a common assignee, the disclosure of which is incorporated herein by reference thereto. Accordingly, a detailed description of the canister 35 is not deemed necessary and this canister 35 will be described here only to the extent necessary for an understanding of the subject invention.

To permit this storage of fuel vapor, a fuel tank vent line 36 extends from the fuel tank 31 to a vapor inlet fitting 37 of the canister 35. A fuel bowl vent line 38 extends from the carburetor fuel bowl 30 to a conventional diaphragm actuated, fuel bowl vent valve 40 associated with the canister 35.

Canister 35 is formed of a cupped housing 41 closed at the bottom by a grid 42 and a cover 43. An annular partition 44 divides the interior of canister 35 into an inner section 45 and an outer section 46 each of which is filled with activated charcoal to form, in effect, a main fuel vapor storage bed. Tank vent line 36 opens through a fitting 37 into the upper portion of outer section 46 while bowl vent line 38 is connected through the vent valve 40 to the upper portion of inner section 45. A valve 47 disposed in vent valve 40 is biased by a spring 48 to permit vapor flow from fuel bowl 30 through bowl vent line 38 to canister 35 when the engine is not operating. When the engine is operating, diaphragm 50 in the vent valve 40 responds via line 49 to the subatmospheric pressure in induction passage 15 downstream of the throttle 16 and lifts valve 47 against the bias of spring 48 to close the vent valve 40.

When the engine is not operating, air and fuel vapor are displaced from fuel bowl 30 and fuel tank 31 and flow through vent lines 38 and 36, respectively, to canister 35. The flow travels downwardly through the inner and outer section 45 and 46 of the main fuel vapor storage bed, into the plenum 51 between grid 42 and cover 43, and then upwardly through a stand-pipe 52 and a canister vent line 53, which in the prior art was normally vented to the atmosphere, as by being connected, for example, to the air cleaner assembly 14 on the clean air side of the air filter 22. The activated charcoal in the fuel vapor storage bed captures the fuel vapor to prevent its loss to the atmosphere.

During engine operation, the subatmospheric pressure in induction passage 15 downstream of throttle 16 draws air through the canister vent line 53 and stand-pipe 52 into plenum 51 and then upwardly through the inner and outer sections 45 and 46 of the fuel vapor storage bed to a conventional purge valve 55 that communicates with the induction passage 15 via a branch of line 49. Such air flow purges the fuel vapor from the charcoal so that the charcoal may again adsorb fuel vapor when the engine is not operating. The purge air flow rate is determined by a pair of purge orifices 56 and **56*a***.

In the construction shown, a diaphragm purge valve 57 may close the purge valve 55 under the bias of a spring 58 during closed throttle engine operation. When throttle 16 is opened, the subatmospheric induction passage pressure from a ported vacuum line 59 is operative to lift diaphragm valve 57 against the bias of spring 58 to open purge fitting 55.

Canister 35 is highly effective in capturing the fuel vapor displaced from the fuel bowl 30 and fuel tank 31. However, the flow of air and fuel vapor through the fuel vapor storage bed may cause some fuel vapor to be purged from the bed and be carried through plenum 51, stand-pipe 52 and canister vent line 53, to the atmosphere.

As previously described, various proposals have advanced in the prior art, such as the use of a supplementary or secondary canisters in conjunction with a main canister of the type described herein whereby to capture such back purge or overflow of fuel vapor from the main canister. As an example, in copending U.S. Pat. application Ser. No. 964,925 entitled "Engine with Evaporative Control System" filed Nov. 30, 1978 in the names of Brian Wayne Green, James Richard Spaulding and Roger John Lundquist and assigned to a common assignee, such a secondary canister is provided by having a secondary fuel vapor storage bed disposed within the air cleaner assembly inboard of the air filter unit therein. With this arrangement, the main storage canister, such as canister 35, is vented to the atmosphere at a location within the chamber in the air cleaner assembly inboard of the secondary fuel vapor storage bed, in terms of the induction fluid flow to the engine. Thus any fuel vapors discharged from the canister vent will either be trapped by this secondary fuel vapor storage bed or flow to the engine, depending, of course, on whether the engine is not operating or is operating, respectively.

Now in accordance with the present invention, there is provided a separate secondary fuel vapor storage canister, hereinafter referred to as secondary canister 60, which is operatively connected so as to receive any back purge or overflow of fuel vapor from the main canister 35. In addition, in accordance with the invention, this secondary canister 60 is so constructed whereby it can be located in the heated air flow path from the heat stove 20 to the induction system for the engine 10, whereby any fuel vapor stored therein can be completely and rapidly purged therefrom during normal engine operation.

Figure 3:
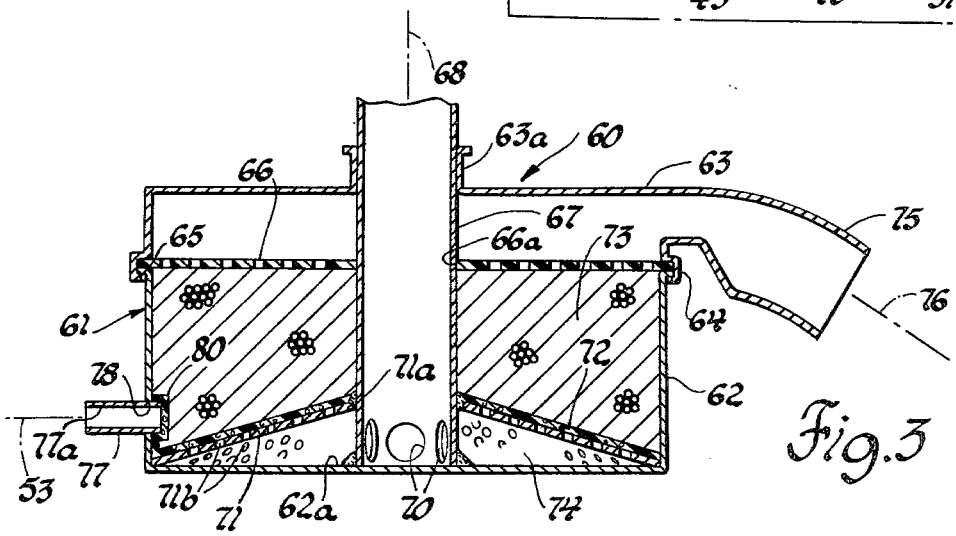

Thus referring now in particular to FIG. 3, the secondary canister 60 includes a housing 61, which in the construction illustrated, is a two-piece housing consisting of a generally cylindrical cup-shaped base 62 and a cover 63 suitably secured together in a unitary structure. For example, in the construction shown, the bottom flange 64 of the cover 63 is clamped over the upper flange 65 of the base 62 with a circular perforated disc screen 66 sandwiched therebetween.

Base 62 is provided with an upstanding tube 67 that extends upward from the interior surface of the lower wall **62*a* of base 62 through a central aperture 66*a* in disc screen 66 and a flanged tubular fitting 63*a* of the cover 63. Tube 67 thus extends outward from cover 63 whereby it can be connected by a conduit 68 to the lateral opening 25 in the snorkel 23 of air cleaner assembly 14**.

Tube 67 adjacent to its lower end, with reference to the Figures, is provided with a plurality of radial ports 70 circumferentially spaced apart with respect to each other. A circular, perforated, frusto conical support disc 71 is suitably secured, as by welding, to the tube 67 at a location directly above the port 70 as shown, the support disc 71 is provided with an enlarged central aperture 71*a* to receive the tube 67 and, the support disc radial outboard of this central aperture 71 is provided with a plurality of openings 71*b*. A pad 72 of a porous open cell material, such as polyurethane foam is supported on top of support disc 71. Pad 72 is thus adapted to serve as an air filter and as a compression member whereby the adsorbent material to be described can be tightly packed against this pad.

The exterior wall of tube 67 and the interior wall of base 62 between the disc 66 and support disc 71 and pad 72 defines an annular chamber that is filled with a bed of suitable adsorbent material, such as activated charcoal 73, whereby to provide a secondary bed of vapor storage material. The support disc 71 and the lower wall 62*a* of base 62 defines with the exterior lower portion of the tube 67 a plenum 74 that is in flow communication with the ports 70 in tube 67.

Cover 63 is provided with a suitable air inlet fitting 75 for connection by a hose 76 to the heat stove 20. Base 62 is provided with a fitting 77 having a passage 77*a* therethrough that extends through a side port 78 in base 62 into the above-described annular chamber containing the secondary bed of vapor storage material. The canister vent line 53 from the main canister 35 is connected to the outboard end of fitting 77 while a cap 80 of porous, open cell material, such as polyurethane foam, is secured to the inboard end of fitting 77. Cap 80 serves as an air filter and also as a diffuser to assure dispersion of any fuel vapor flowing through the canister vent line 53 into the secondary bed of vapor storage material 73. It will be appreciated that, if desired, a different form of diffuser may also be used in lieu of the diffuser cap 80.

The canister housing 61 thus defines an air flow path through the interior thereof having as its inlet the air inlet fitting 75 and as its outlet the upper free end of tube 67 with the secondary bed of vapor storage material, such as the activated charcoal 73, positioned in this flow path intermediate the inlet and outlet.

From the above description of the construction of the secondary canister, it will be observed that when the engine is not in operation, any back purge or overflow of fuel vapor from the main canister 35 will be conveyed via the canister vent line 53 to the vapor storage bed 73 in the secondary canister 60. These vapors will be absorbed by the material of the vapor storage 73.

During engine operation, air heated by the heat stove 20 will flow through the hose 76 and inlet fitting 75 into the interior of the secondary canister 60. This heated air will then pass down through the screen 66 to flow through the secondary vapor storage bed 73 and out through the ports 70 into the tube 67 for flow therefrom into the induction system of the engine 10. By using heated air, any fuel vapor stored in the secondary vapor storage bed 73 will be rapidly and completely purged in a relatively short period of time during engine operation.

To control flow of heated air from the heat stove 20 to the induction system through the air cleaner assembly 14, the air cleaner assembly is provided with a thermal sensor 85 and a vacuum operated snorkel damper mechanism 86 (FIGS. 1 and 2), of the type shown, for example, in U.S. Pat. No. 3,459,163 entitled "Thermostatic Control" issued Aug. 5, 1969 to Donald B. Lewis, that are operative so as to maintain the induction air flow at a substantially constant temperature.

In addition, during engine operation when the purge of fuel vapor is effected from the main canister 35, in the manner described, heated air in the flow path through the secondary canister 60 will be drawn via the canister vent line 53 into the main canister 35. By flowing heated air through the main vapor storage bed in canister 35, the purging of fuel vapors from this main canister will be enhanced as compared to the normal use of ambient air to effect this purging. Thus it will be appreciated, that even during short periods of engine operation cycles, the secondary vapor storage bed 73 can be completely purged and the complete purging of fuel vapor from the main canister 35 will be enhanced.

By the use of a secondary canister 60 in accordance with the invention, the volume of the material in the secondary vapor storage bed can be reduced relative to that used or required in the known prior art secondary canisters. Thus, in a particular engine application, the volume of the fuel vapor storage material in a secondary canister 60, in accordance with the invention, was approximately 25% less than that required in a secondary canister of the type disclosed, for example, in the above-identified U.S. Pat. application Ser. No. 964,925 to perform the same function of preventing flow of fuel vapor from a main fuel vapor storage canister escaping to the atmosphere.

The embodiments of the invention in which an exclusive property or privilege is claimed are defined as follows:

1. In an engine having a fuel supply system including a fuel tank, a main canister containing a main body of fuel vapor storage material, a vent line means for delivering fuel vapor from the fuel supply system to the storage material, a throttle valve controlled induction passage means for delivering air to the engine, the induction passage means including a heat stove for heating air and having an air inlet located in heat exchange relationship to the exhaust manifold of the engine and an air outlet for supplying engine heated air, as controlled by a snorkel damper mechanism, into the induction passage means upstream of the throttle valve, a canister air vent line to the canister, and a purge means from the canister for delivering fuel vapor stored in the storage material therein to the induction passage downstream of the throttle valve, the improvement comprising:

a fuel vapor secondary canister containing a secondary bed of fuel vapor storage material therein; said secondary canister defining an air flow path therethrough and being connected at one end to the air outlet of the air heat stove and having its other end connected in flow communication as controlled by the snorkel damper mechanism with the induction passage means upstream of the throttle valve; said secondary bed of vapor storage material being positioned in said flow path between opposite ends thereof; and a port means in said secondary canister opening at one end into said secondary bed on the downstream side thereof in terms of heated air flow through said air path and connected at its opposite end to the canister vent line, whereby any flow of fuel vapor from the main canister will be stored in said secondary bed of fuel vapor storage material in said secondary canister so that during engine operation heated air flowing through said secondary canister will rapidly purge all fuel vapor therefrom.

2. In an engine having a fuel supply system including a fuel tank, a main fuel vapor storage canister containing a body of fuel vapor storage material, a vent line means for delivering fuel vapor from the fuel supply system to the main vapor storage canister, a throttle valve controlled induction passage means for delivering air to the engine, the induction passage means including an air heat stove unit having an air inlet located in heat exchange relationship to the exhaust manifold of the engine and an air outlet for supplying engine heated air into the induction passage means upstream of the throttle valve, a canister vent line connected to the main vapor storage canister, and a purge means from the canister for delivering fuel vapor stored in the storage material therein to the induction passage downstream of the throttle valve, the improvement comprising:

a fuel vapor secondary canister containing a secondary bed of fuel vapor storage material therein; said secondary canister defining an air flow path therethrough and being connected at one end to the air outlet of the air heat stove and having its other end connected in flow communication with the induction passage means upstream of the throttle valve; said secondary bed of vapor storage material being positioned in said flow path intermediate said opposite ends of said flow path; and a port means in said secondary canister opening into said secondary bed of vapor storage material and being connected to the canister vent line whereby any flow of fuel vapor from the main fuel vapor storage canister through the canister vent line will be stored in said secondary canister so that during engine operation heated air will flow through said secondary canister to rapidly purge all fuel vapor therefrom to the induction passage means and heated air is available to effect purging of fuel vapor from the main canister.

* * * * *